US007146818B2

(12) United States Patent
Hawkins, Jr. et al.

(10) Patent No.: US 7,146,818 B2
(45) Date of Patent: Dec. 12, 2006

(54) COOLING BANK CONTROL ASSEMBLY FOR A BEVERAGE DISPENSING SYSTEM

(75) Inventors: John T. Hawkins, Jr., Adkins, TX (US); Stephen K. Versteeg, Tarpley, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 0 days.

(21) Appl. No.: 10/614,842

(22) Filed: Jul. 8, 2003

(65) Prior Publication Data

US 2004/0003600 A1 Jan. 8, 2004

Related U.S. Application Data

(63) Continuation of application No. 10/135,651, filed on Apr. 30, 2002, now Pat. No. 6,662,573.

(51) Int. Cl.
*F25D 3/00* (2006.01)

(52) U.S. Cl. ..... 62/59; 62/389; 62/393

(58) Field of Classification Search ..... 62/59, 62/68, 138, 139, 201, 228.2, 389, 390, 393, 62/394; 222/146.6
See application file for complete search history.

(56) References Cited

U.S. PATENT DOCUMENTS 4,497,179 A * 2/1985 Iwans ..... 62/59
4,823,556 A * 4/1989 Chesnut ..... 62/139
4,934,150 A * 6/1990 Fessler ..... 62/59
4,939,908 A * 7/1990 Ewing et al. ..... 62/139
5,234,131 A * 8/1993 Griffin ..... 222/146.6
5,279,446 A * 1/1994 Cook et al. ..... 222/54
5,443,763 A * 8/1995 Notar et al. ..... 261/140.1
5,499,744 A * 3/1996 Hawkins ..... 222/129.1
5,502,977 A * 4/1996 Ziesel et al. ..... 62/139
5,535,600 A * 7/1996 Mills ..... 62/390
5,606,864 A * 3/1997 Jones ..... 62/139
5,987,897 A * 11/1999 Hall ..... 62/59
6,158,235 A * 12/2000 Hawkins et al. ..... 62/399
6,324,911 B1 * 12/2001 Scarffe ..... 73/627
6,449,966 B1 * 9/2002 Bethuy et al. ..... 62/139

FOREIGN PATENT DOCUMENTS

EP 0315439 A2 * 5/1989
GB 2205638 A * 12/1998

* cited by examiner

*Primary Examiner*—Mohammad M. Ali
(74) *Attorney, Agent, or Firm*—Christopher L. Makay

(57) ABSTRACT

A beverage dispensing system includes a cooling chamber filled with a bath of cooling fluid for cooling beverage fluids. A cooling unit, including an evaporator coil extending from the cooling unit into the cooling chamber, freezes the cooling fluid into a frozen cooling bank about the evaporator coil. Sensor units positioned at desired locations about the evaporator coil provide output corresponding to the size and shape of the frozen cooling bank. Also, a control unit reads the output from the sensor units and operates the cooling unit to regulate the growth of the frozen cooling bank. In addition, the control unit may read output from temperature sensors attached to dispensing valves or monitoring ambient temperature conditions.

14 Claims, 6 Drawing Sheets

COOLING BANK CONTROL ASSEMBLY FOR A BEVERAGE DISPENSING SYSTEM

CROSS REFERENCE TO RELATED APPLICATION

This application is a continuation application of application Ser. No. 10/135,651 filed on Apr. 30,2002 now U.S. Pat. No. 6,662,573.

BACKGROUND OF THE INVENTION

1. Field of the Invention

The present invention generally relates to dispensing equipment and, more particularly, but not by way of limitation, to a control assembly for a beverage dispensing system cooling unit. The control assembly regulates growth of a frozen cooling bank to achieve optimal thermodynamic performance under various conditions.

2. Description of the Related Art

In the beverage dispensing industry, it is highly desirable to serve drinks at a designated cold temperature. To accomplish this, beverage dispensing systems typically include cooling units to lower the temperature of beverage fluids, such as flavored syrup and a diluent of plain or carbonated water, prior to forming and dispensing a desired beverage.

One cooling unit well known in the industry is a refrigeration unit featuring a cooling fluid bath. The cooling fluid bath includes a cooling chamber filled with a cooling fluid, which is typically water, disposed within a beverage dispenser. The cooling unit includes an evaporator coil that extends from the cooling unit into the cooling chamber so that the evaporator coil is submerged within the cooling fluid. While the cooling unit is in operation, cooling fluid freezes in a bank around the evaporator coil. Beverage lines submerged within the unfrozen cooling fluid contain warm beverage fluids. The unfrozen cooling fluid serves as an intermediary for convective heat exchange between the beverage fluids and the frozen bank. Effectively, the frozen bank functions as a heat sink by absorbing heat from warm beverage fluids flowing within respective beverage lines. As beverage fluids are dispensed, the cooling unit is turned on and off to maintain a properly sized frozen bank. Maintaining a frozen bank of proper size and shape is essential to maintaining optimal thermal performance of the cooling unit.

Unfortunately, current designs for beverage dispensing units do not provide for accurate growth control of the frozen bank resulting in improper sizes and shapes. As a result, the thermal performance of the cooling unit suffers. Generally, frozen banks are shaped by positioning a single sensor unit at a desired distance from the evaporator coil within the bath of unfrozen cooling fluid. When the sensor unit detects a desired size of the bank, the sensor unit sends a signal to turn off the cooling unit to stop the growth of the bank. However, external factors can cause undetected deformities in the bank because the size and shape of the bank is monitored at only one location.

For example, two external factors are dispensing valve temperature loading and ambient temperature conditions. Typically, dispensing valve temperature loading is caused by frequent use of a particular, often popular, dispensing valve. When this happens, the associated beverage line raises to a higher temperature than the rest of the beverage lines. As a result, an adjacent region of the bank will melt while absorbing the heat from the higher temperature beverage line. Unfortunately, if the single sensor unit is located in another region, it cannot detect this localized melting. Therefore, continued use of the same dispensing valve will result in the dispensing of beverage fluids at a higher than desired temperature. In contrast, if the single sensor is located at the region of localized melting, the sensor will signal the cooling unit to turn on resulting in overgrowth of the bank at other regions. Overgrowth of the bank can damage beverage dispensers by freezing the beverage fluid lines and, potentially, freezing an entire cooling fluid bath. Additionally, extreme ambient temperature conditions can also cause other undetected deformities in the frozen bank. Extremely hot ambient conditions can cause imbalanced reduction in size of the frozen bank. This condition can result in inadequate thermodynamic performance. Extremely cold ambient temperatures can cause overgrowth of the bank resulting in the same problems as described above.

In as much, the unfavorable formation of misshapen banks greatly disrupts the optimal circuitous path of convective heat transfer created between the warm beverage fluids within the beverage fluid lines and the bank. Accordingly, there is a long felt need for a apparatus and method for a beverage dispensing system cooling unit that regulates growth of a frozen cooling bank for optimal thermodynamic performance.

SUMMARY OF THE INVENTION

In accordance with the present invention the apparatus comprises a cooling unit, an array of sensor units, and a control unit. The cooling unit is a standard refrigeration unit well known in the art comprising a compressor, evaporator coil, condenser coil, and expansion valve. The cooling unit freezes cooling fluid in a tubular shaped bank about the evaporator coil to provide a means for heat sink for cooling beverage fluids. The array of sensor units includes a multiplicity of sensor units well known in the art positioned at a desired distance from the evaporator coil to monitor the size of the frozen bank. The control unit is a microprocessor well know to those in the art and is operatively linked with the cooling unit, and the array of sensor units.

In accordance with the present invention, the control unit utilizes a program routine to determine what size and shape frozen bank provides the optimal thermodynamic performance. To accomplish this, the control unit uses the frozen bank size data from the sensor units to determine when to turn the cooling unit on and off. In addition, the control unit may receive data from a multitude of other sensors, such as an ambient temperature sensor or a dispensing valve loading sensor, to determine the optimal shape and size of the frozen bank.

It is therefore an object of the present invention to provide a control assembly and method of use for a beverage dispensing system cooling unit that satisfies the need to regulate the growth of a frozen cooling bank to achieve optimal thermodynamic performance under various conditions.

Still other objects, features, and advantages of the present invention will become evident to those skilled in the art in light of the following.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENT

As required, detailed embodiments of the present invention are disclosed herein. However, it is to be understood that the disclosed embodiments are merely exemplary of the invention, which may be embodied in various forms, the figures are not necessarily to scale, and some features may be exaggerated to show details of particular components or steps.

Figure 1:
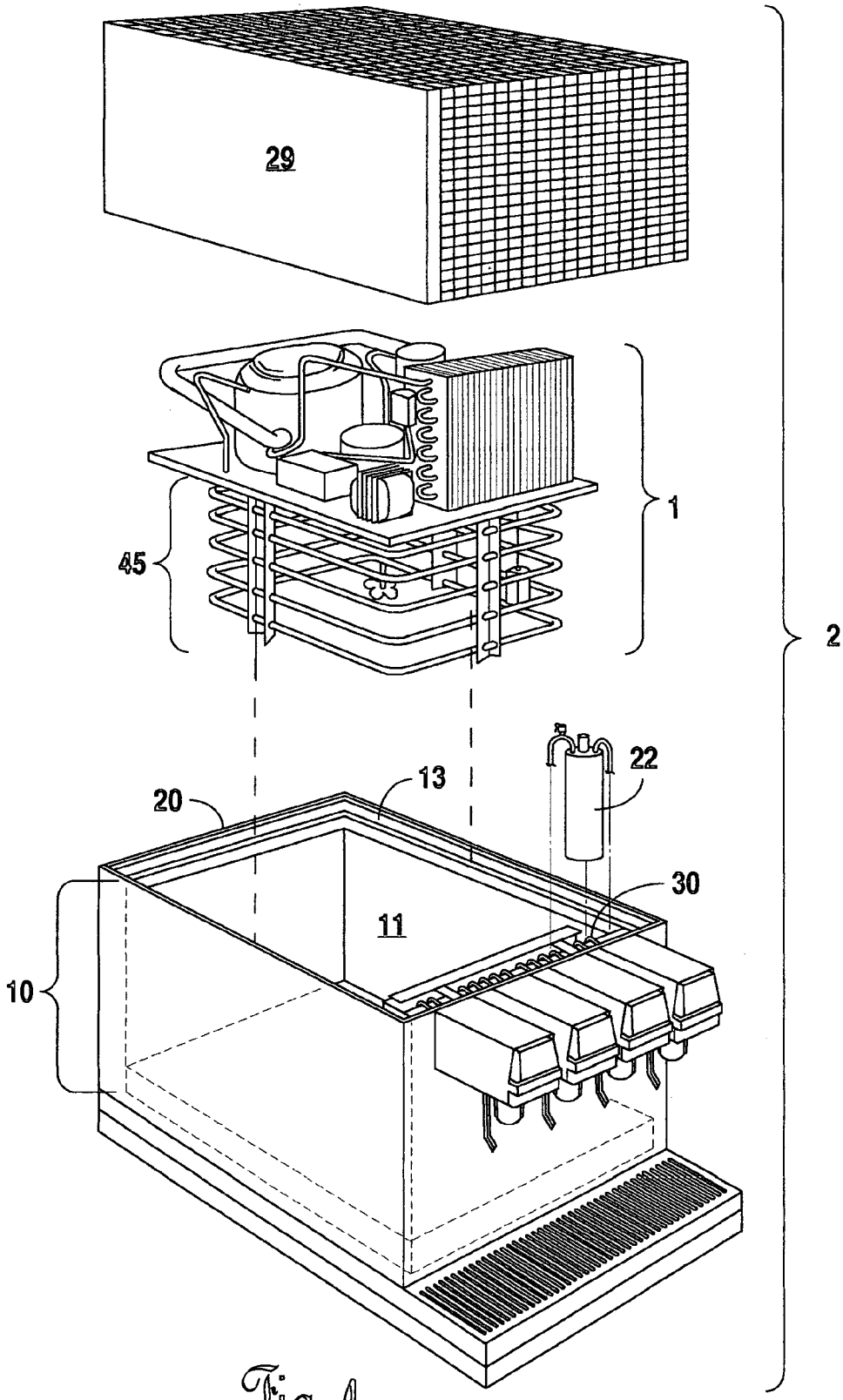
FIG. 1 is an exploded view of a beverage dispensing system.
Figure 2:
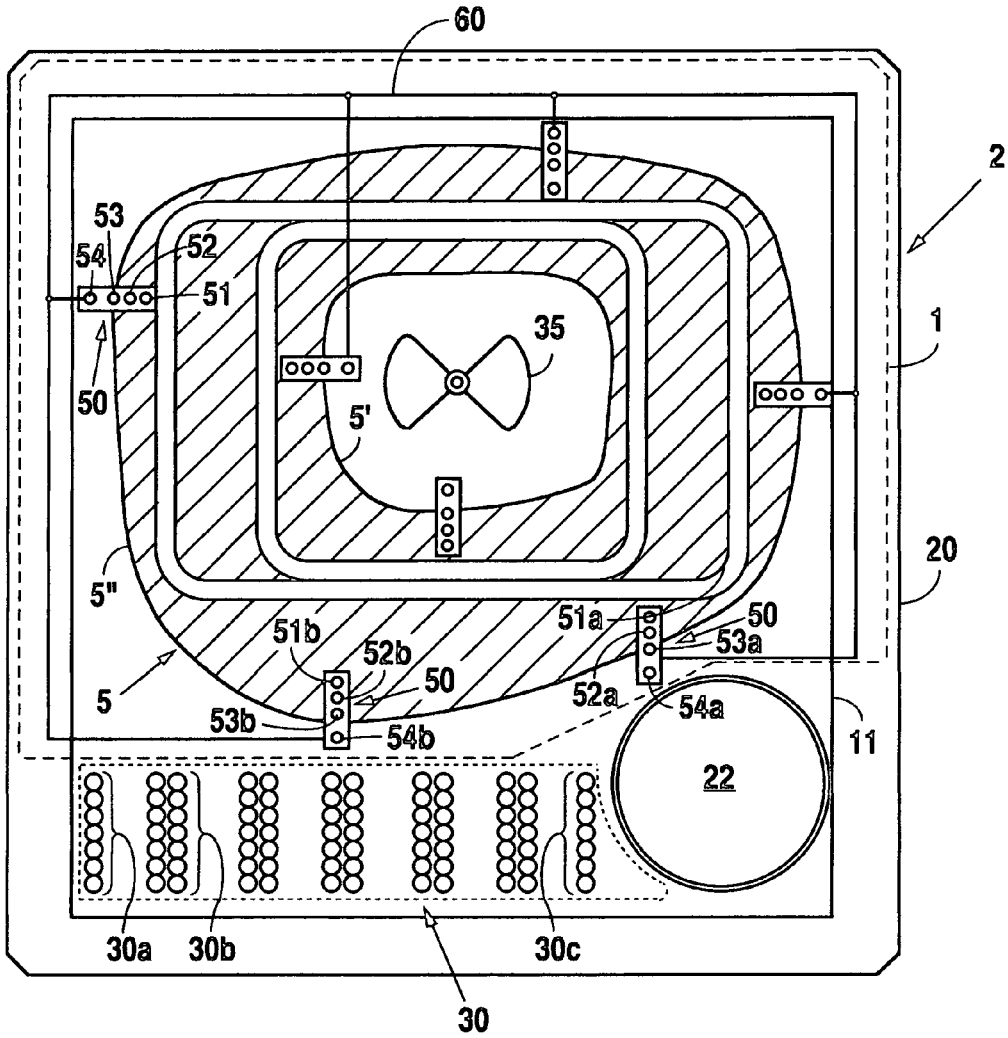
FIG. 2 is a top view illustrating a cooling unit for a beverage dispensing system according to a preferred embodiment featuring an array of sensor units for controlling bank growth.

As illustrated in FIGS. 1–2, a beverage dispensing system 2 includes a cooling unit 1, a cover 29, and a housing 20 with an exterior and interior portion. A cooling chamber 11, including a bottom and side portions, is disposed within the interior of the housing 20. The cooling chamber 11 contains a cooling fluid 7, which is typically water, thereby forming a cooling fluid bath. In addition, dispensing valves 28 are secured to the exterior portion of the housing 20 and are in communication with a dispensing assembly disposed within the interior portion of the housing 20. The dispensing valves 28 and dispensing assembly form and dispense a desired beverage therethrough.

The dispensing assembly includes beverage lines 30 disposed within the cooling chamber 11 for carrying beverage fluids therein used in the formation of a desired beverage. In particular, the beverage lines 30 include the flavored syrup lines 30*b* linked from a flavored syrup source (not shown) to the dispensing valves 28. For forming non-carbonated beverages, the beverage lines 30 include plain water lines 30*a* linked from a plain water source (not shown) to the dispensing valves 28. For forming carbonated beverages, such as cola, the dispensing assembly includes a carbonator 22 disposed within the cooling chamber 11 linked to a carbon dioxide source (not shown) and the plain water source (not shown). Inside the carbonator 22, the plain water and carbon dioxide are combined to form carbonated water. Accordingly, carbonated water lines 30*c* are linked from the carbonator 22 to the dispensing valves 28 to provide a supply of carbonated water. At the dispensing valves 28, flavored beverage syrup is combined with plain or carbonated water at an appropriate ratio to form and dispense the desired beverage.

Figure 3:
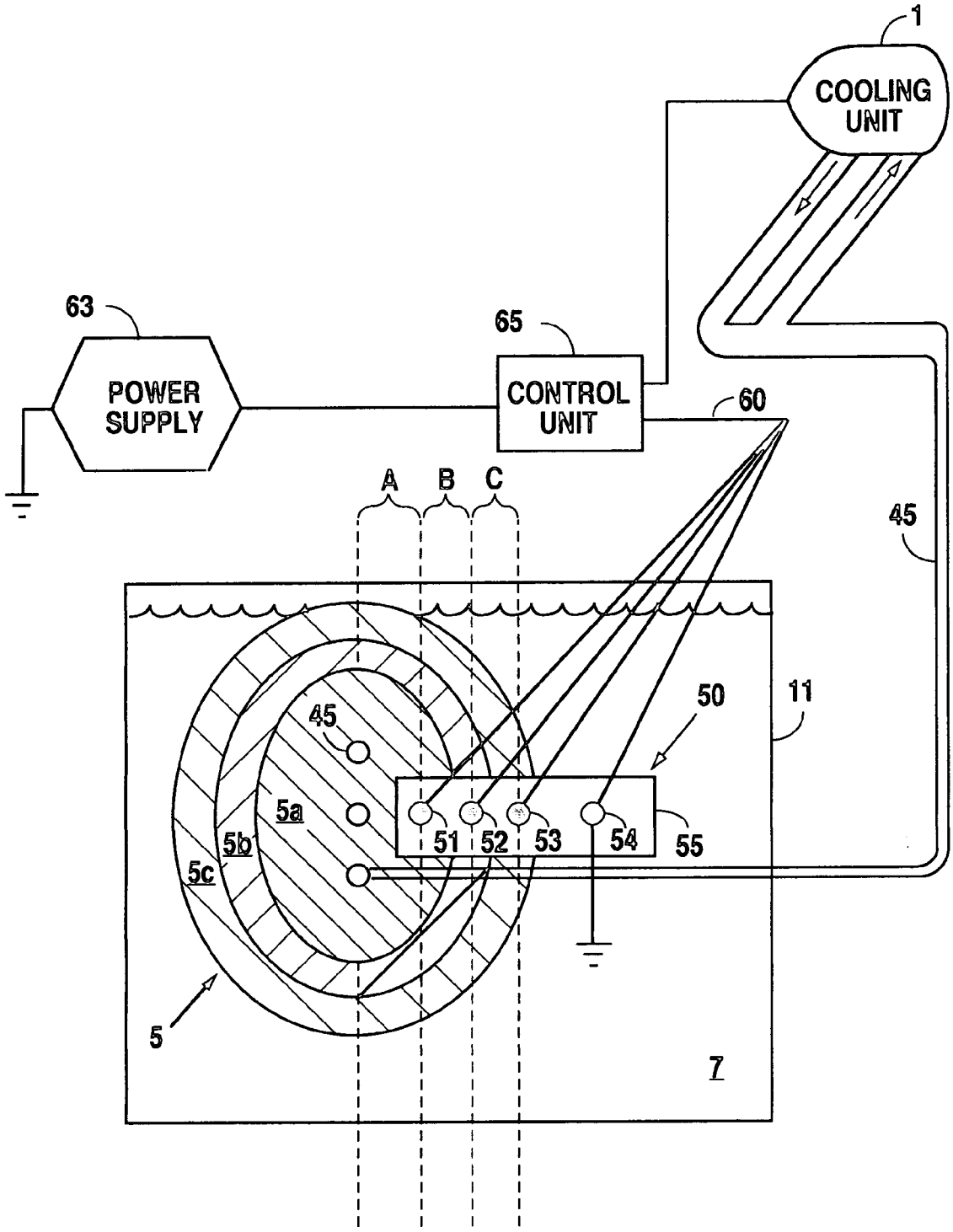
FIG. 3 is a schematic diagram illustrating a control unit in operative engagement with a cooling unit and a sensor unit according to the preferred embodiment for controlling bank growth.

As illustrated in FIGS. 2–3, the beverage dispensing system 2 includes a control unit 65 operatively linked with the cooling unit 1 for freezing the cooling chamber 11. In the preferred embodiment, the control unit 65 comprises a microprocessor of a type well known in the industry. Furthermore, the control unit 65 is electrically linked with a power supply 63 for receiving power therefrom. In the preferred embodiment, the cooling unit 1 comprises a standard refrigeration unit of a type well known to those of ordinary skill in the art. The cooling unit 1 includes an evaporator coil 45 that extends from the cooling unit 1 into the cooling chamber 11 so that the evaporator coil 45 is submerged within the cooling fluid 7. When the cooling unit 1 is in operation, cooling fluid 7 freezes in a bank 5 about the evaporator coil 45. The unfrozen cooling fluid 7 serves as an intermediary for convective heat exchange between the beverage lines 30 and the frozen bank 5. Effectively, the frozen bank 5 functions as a heat sink by absorbing heat from warm beverage fluids flowing within respective beverage lines 30. As beverage fluids are dispensed, the cooling unit 1 is turned on and off by the control unit 65 to maintain a properly sized frozen bank 5.

It should be added that the evaporator coil 45 provides a support frame for the bank 5. As a result, the shape of the evaporator coil 45 generally determines the overall shape of the bank 5. In the preferred embodiment, FIG. 2 shows the evaporator coil 45 as tubular in shape, thereby allowing cooling fluid 7 to flow across an inner surface 5' and an outer surface 5". Additionally, an agitator 35 may be provided to better facilitate the flow of cooling fluid 7 through the inner surface 5'. Although the bank 5 in the preferred embodiment is a tubular shape, those of ordinary skill in the art will recognize that other bank shapes may be employed.

The beverage dispensing system 2 includes an array of sensor units 50 disposed within the housing 20 and operatively linked with the control unit 65 for communicating with the cooling unit 1. The array of sensor units 50 includes a multiplicity of sensor units 50, with each sensor unit 50 positioned within the cooling chamber 11 at a desired distance from the evaporator coil 45. Each sensor unit 50 comprises an ice bank sensor well known to those of ordinary skill in the art. In the preferred embodiment, each sensor unit 50 includes four control probes 51–54 set in a row, each probe at a greater distance from the evaporator coil 45, and enclosed in a sensor unit housing 55. The sensor unit housing 55 enables convenient placement of each sensor unit 50 about the evaporator coil 45. The fourth control probe 54 on each sensor unit is used as a reference probe to compare a voltage reading to the first control probe 51, second control probe 52, and third control probe 53. The control unit 65 monitors the voltage readings of all three control probes 51–53 to determine if each control probe is covered by cooling fluid 7 or by the frozen bank 5. Subsequently, the control unit 65 processes this information through a program routine 200 as discussed below to determine when to turn the cooling unit 1 on and off.

Figure 5:
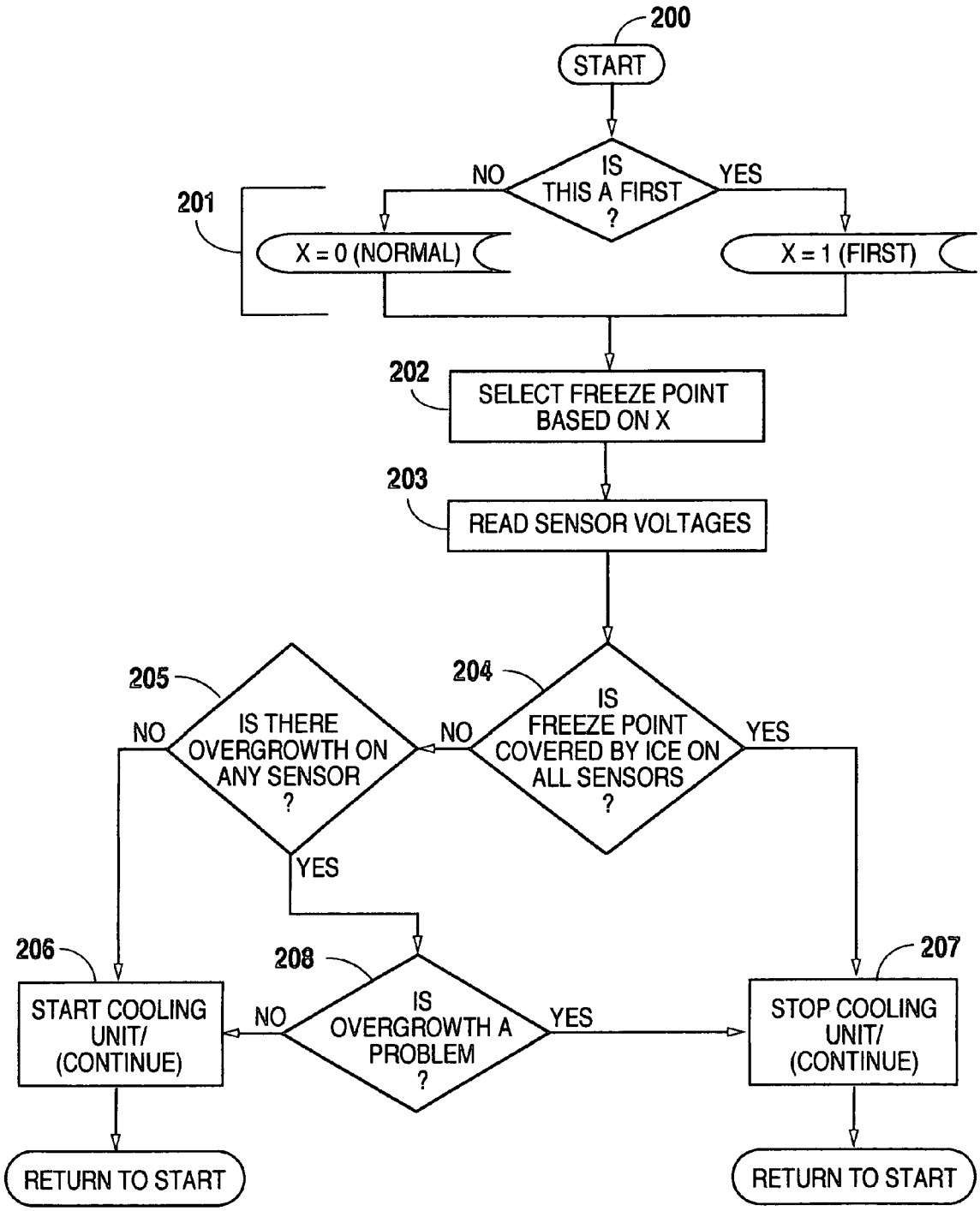
FIG. 5 is a flow diagram illustrating a preferred method by which a program routine controls bank growth.

FIG. 5 is a flow diagram illustrating a program routine 200 used by the control unit 65 in the preferred embodiment. During operation, the control unit 65 continuously runs through the program routine 200 reacting to the changing conditions of the beverage dispensing system 2. When the beverage dispensing system 2 is initially turned on, the control unit 65 immediately starts the program at step 201. In step 201, the program 200 determines if the cooling unit 1 has completed any freeze cycles since the beverage dispensing system 2 has turned on. A freeze cycle is defined as a period of continuous cooling unit 1 operation from the starting of the cooling unit 1 to the stopping of the cooling unit 1. If the cooling unit 1 has not completed any freeze cycles, the program 200 concludes that the current cycle is a first-freeze cycle. Accordingly, this condition is assigned a binary code, such as 0, and recorded under the variable x. If the cooling unit 1 has already completed a first-freeze cycle, the program 200 concludes that the current cycle is a normal-freeze cycle. Similarly, this condition is assigned a different binary code, such as 1, and recorded under the variable x.

In step 202, the program 200 selects which control probe 51–53 will be used as the freeze point based on the binary code assigned to variable x in step 201. Control probe 54 cannot be selected because it must be used as a reference probe. The freeze point is defined as the location that the outer surface 5" of the frozen bank 5 must reach to produce an overall frozen bank 5 of desired size and weight. In the preferred embodiment, when variable x is equal to 0, representing a first-freeze cycle, the first control probe 51 will be selected as the freeze point. Likewise, when variable x is equal to 1, representing a normal-freeze cycle, the second control probe 52 will be selected as the freeze point. Therefore, referring to FIG. 3, selecting the first control probe 51 as the freeze point will produce a small bank 5*a*, while selecting the second control probe 52 will produce a medium bank 5*b*. Typically, the first freeze cycle produces a bank 5 with an unstable final size and shape. Selecting a control probe to produce a smaller bank during a first-freeze Cycle allows the bank to grow to a stable final size and shape during subsequent normal-freeze cycles.

For purposes of flexibility, the control unit 65 can be preprogrammed to select any of the control probes in step 202. The flexibility to preprogram different control probes is desirable to compensate for different ambient temperatures or variances in the amount of use of the beverage dispensing system 2. While the control unit 65 in the preferred embodiment is preprogrammed to select either the first control probe 51 or the second control probe 52 in step 202, it can also be preprogrammed to select the second control probe 52 and third control probe 53. In this case, when variable x is equal to 0, representing a first-freeze cycle, the second control probe 52 will be selected as the freeze point. Likewise, when variable x is equal to 1, representing a normal-freeze cycle, the third control probe 53 will be selected as the freeze point. Therefore, referring to FIG. 3, selecting the second control probe 52 as the freeze point will produce a medium bank 5*b*, while selecting the third control probe 53 will produce a large bank Sc. In addition, while sensor units 50 with four control probes 51–54 are used in the preferred embodiment, sensor units with additional or fewer probes may also be used to provide for a greater or lesser choice of bank size and shape in the way described above.

Referring back to the preferred embodiment in FIG. 5, step 203 reads the voltages from each sensor unit 50. Next, step 204 compares the readings from the first three control probes 51–53 in step 203 to the fourth control probe 54, the reference probe, to determine if the outer surface 5" of the bank 5 has reached the selected freeze point, which is the second control probe 52, on all the sensor units 50. If the bank 5 has reached the second control probe 52 on all the sensor units 50, the program 200 advances to step 207. Step 207 stops the operation of the cooling unit 1 and advances the program 200 back to the start at step 201.

However, if the bank 5 has not reached the second control probe 52 in step 204 on all the sensor units 50, the program 200 instead advances to step 205. Step 205 checks to see if the frozen bank 5 has grown past the second control probe 52 to the third control probe 53 on any of the sensor units 50. This phenomenon is referred to as overgrowth. Overgrowth of the bank 5 can cause damage to the beverage dispensing system 2, such as freezing the beverage lines 30. If there is no overgrowth on any of the sensor units 50, the program 200 proceeds to step 206. However, if overgrowth is detected on any sensor unit 50, step 205 will instead advance to step 208. Step 208 determines if the overgrowth presents a potential to cause damage. Some sensor units 50 may be able to tolerate overgrowth without causing damage because of their location. This information is pre-loaded into the control unit 65 to be used in step 208. If the overgrowth presents a potential to cause damage, step 208 will advance to step 207 to stop the cooling unit 1 ending the freezing cycle. If the overgrowth does not present a potential to cause damage, step 208 will advance to step 206. Step 206 signals the cooling unit to start operation, or continue operation when it is already in operation mode, and advances the program 200 back to the start at step 201.

As previously described, when the outer surface 5" of the bank 5 grows large enough to reach the freeze point at every sensor unit 50, step 204 advances to step 207 to turn off the cooling unit 1 ending the freeze cycle. Then, the control unit 65 returns to the beginning of the routine at step 201 to rerun the program 200. With the cooling unit 1 turned off, the bank 5 will shrink in size as a result of melting during a melting cycle. A melting cycle is defined as a period of continuous cooling unit 1 non-operation from the stopping of the cooling unit 1 to the starting of the cooling unit 1. The rate of melting fluctuates with the ambient conditions, and the rate of use of the beverage dispenser unit 2. When the outer surface 5" of the bank 5 recedes past the freeze point, the second control probe 52, at any sensor unit 50 and there is no dangerous overgrowth at any sensor unit 50, step 206 will turn on the cooling unit 1 again for another freezing cycle. Thus, by monitoring the size of the bank 5 with an array of sensor units 50 in conjunction with a program routine 200, the beverage dispensing system 2 can regulate the growth of the frozen bank 5 to achieve optimal thermodynamic performance. While the preferred embodiment selects the freeze point based on the freeze cycle, any multitude of variables may be considered in a multitude of manners and sequences. For example, freezing cycles or melting cycles may be started or terminated based on the time of day or the amount of usage. In some situations, this can provide longer or shorter cycle times to allow the frozen bank to stabilize its size and shape.

Figure 4:
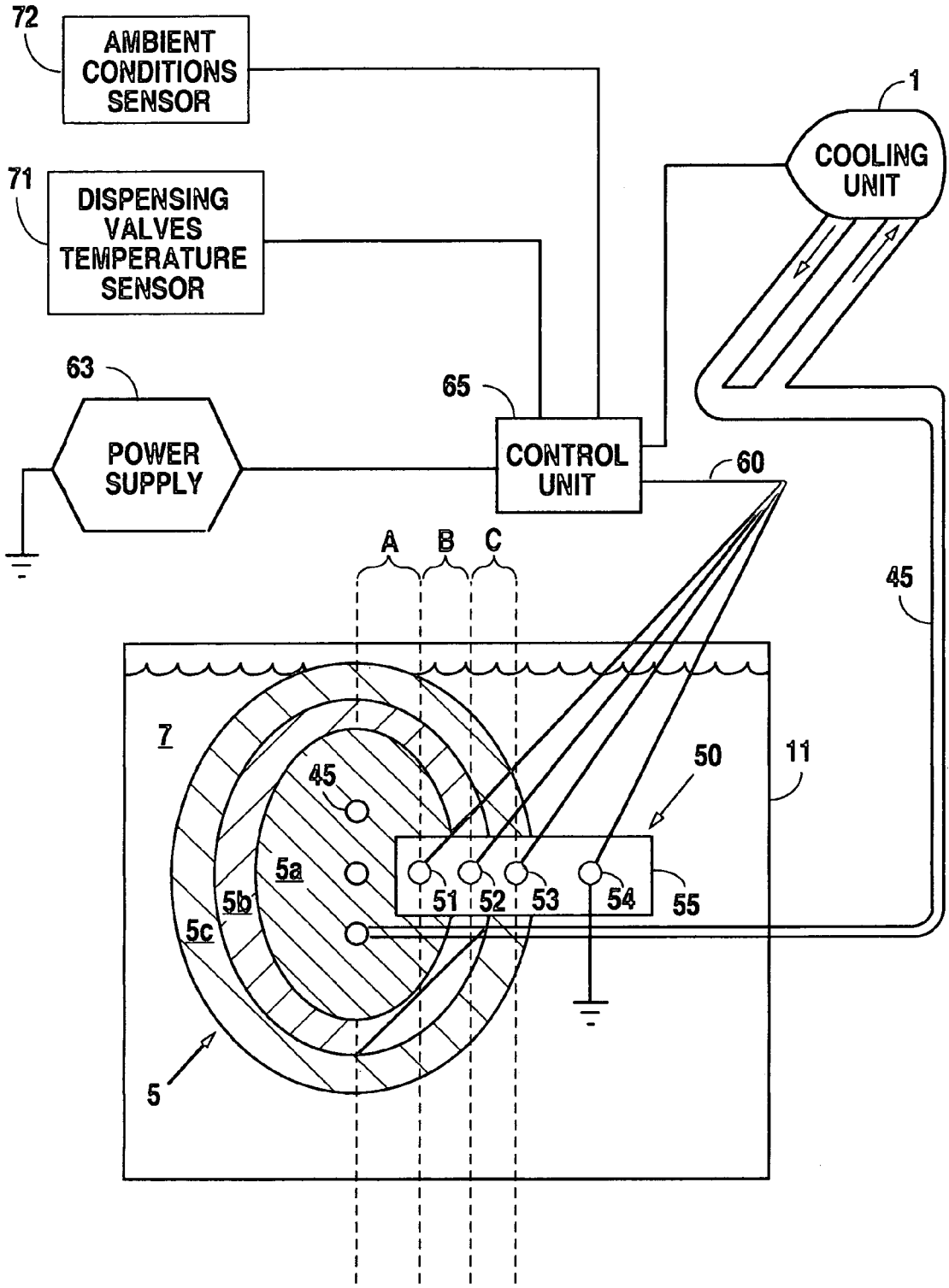
FIG. 4 is a schematic diagram illustrating a control unit in operative engagement with the cooling unit and the sensor unit according to an alternative embodiment for controlling bank growth.

As illustrated in FIG. 4, the alternate embodiment of the control unit 65 in operative engagement with the cooling unit 1 and sensor unit 50 is similar to the preferred embodiment in FIG. 3. Therefore, all matching parts illustrated in FIG. 4 are appropriately marked with the same numbers as their counterparts illustrated in FIG. 3. In addition, all matching parts perform as described in the preferred embodiment. Referring to FIG. 4, the control unit 65 is operatively engaged with the cooling unit 1, sensor unit 50, and power supply 63 in the same fashion as described in the preferred embodiment. However, the control unit 65 in the alternate embodiment is also operatively engaged with an ambient conditions sensor 72 and a dispensing valves temperature sensor 71 to monitor data used to select a freeze point in a program routine 300. The ambient conditions sensor 72 comprises of a thermometer of a type well known to those of ordinary skill in the art and mounted on the outside (not shown) of the beverage dispensing system 2 to measure the ambient temperature of the room. This will allow the program 300 to automatically compensate for high or low ambient temperatures when selecting a freeze point. The dispensing valves temperature sensor 71 comprises a thermometer of a type well known to those of ordinary skill in the art and mounts inside (not shown) each of the dispensing valves 28 to measure the temperature of the beverage fluids dispensing therethrough. This will allow the program 300 to automatically compensate for dispensing valve temperature loading when selecting a freeze point.

Figure 6:
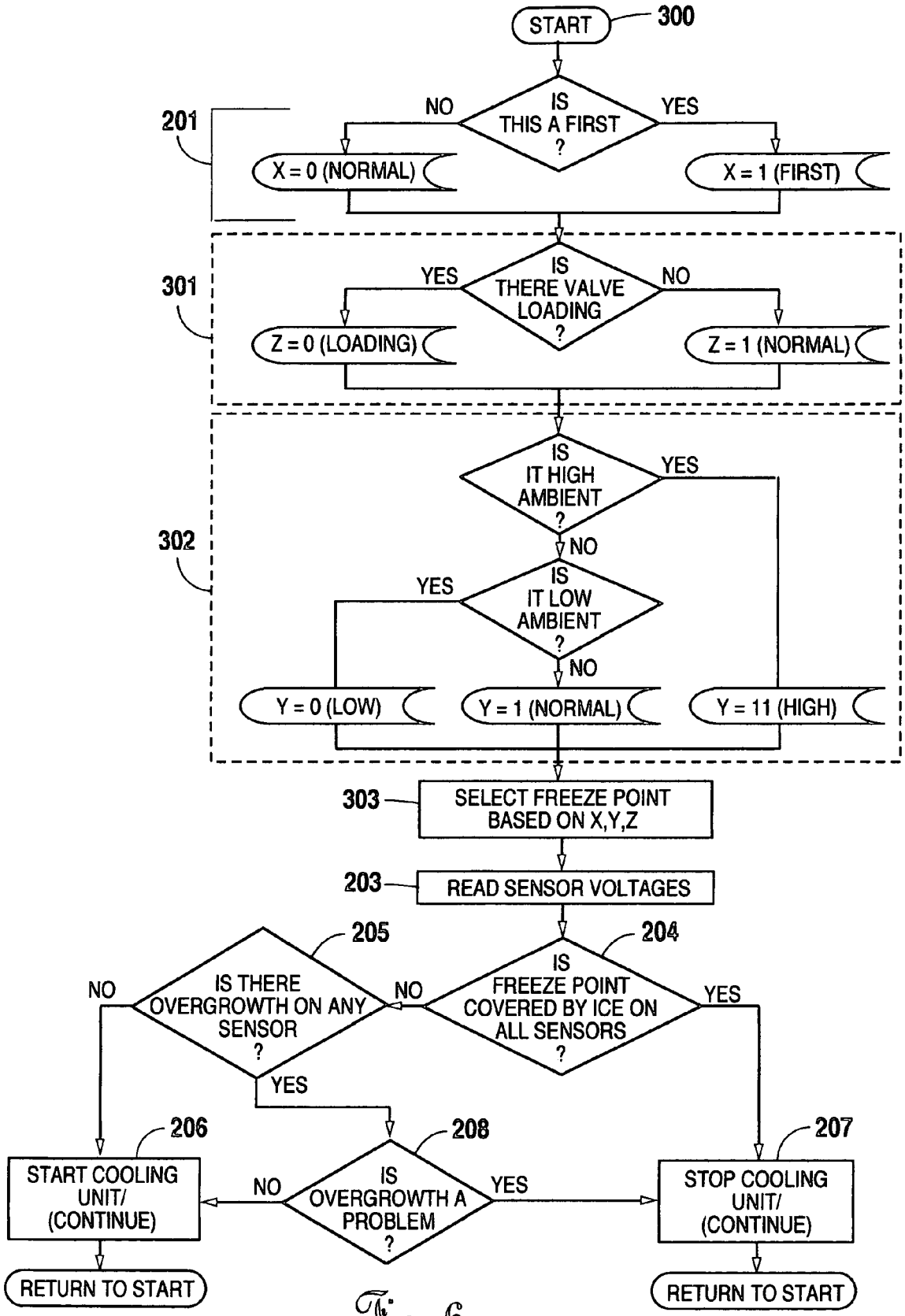
FIG. 6 is a flow diagram illustrating an alternative method by which a program routine controls bank growth.

As illustrated in FIG. 6, the alternate embodiment of the program routine 300 is similar to the program routine 200 illustrated in FIG. 5. Therefore, all matching steps illustrated in FIG. 6 are appropriately marked with the same numbers as their counterparts illustrated in FIG. 5. In addition, all matching steps perform as described in the preferred embodiment. Referring to FIG. 6, the alternate embodiment of the program routine 300 contains three additional steps (301, 302, and 303) than the preferred embodiment. The additional steps use the data from the dispensing valves temperature sensor 71 and ambient conditions sensor 72 to select the appropriate freeze point, similar to step 201 and 202 in the preferred embodiment. For the purposes of this description, we will assume matching step 201 assigns variable x a binary code of 1 representing a normal-freeze cycle.

In step 301, the program 200 compares a temperature reading from the dispensing valves temperature sensor 71 against a predetermined temperature range, such as 35°–40° F., that is entered into the control unit 65 before operation. While the temperature range in the alternate embodiment is 35°–40° F., any temperature range that allows the program 200 to select an appropriate freeze point may be used. If the temperature reading is within the range, step 301 assigns a binary code, such as 1, for a normal condition and records it under the variable y. If it is above the range, step 301 assigns a binary code, such as 0, for a valve loading condition and records it under the variable y. For the purposes of this description, we will assume variable y is assigned a binary code of 0 representing valve loading.

Next, step 302 compares a temperature reading from the ambient conditions sensor 72 against a predetermined temperature range, such as 68°–78° F. that is entered into the control unit 65 before operation. While the temperature range in the alternate embodiment is 68°–78° F., any temperature range that allows the program 200 to select an appropriate freeze point may be used. If the temperature reading is within the range, step 302 assigns a binary code, such as 1, for a normal ambient condition and records it under the variable z. If it is below the range, step 302 assigns a binary code, such as 0, for a low ambient condition and records it under the variable z. Finally, if it is above the temperature range, step 302 assigns a binary code, such as 11, for a high ambient condition and records it under the variable z. For the purposes of this description, we will assume variable z is assigned a binary code of 0, representing a low ambient condition.

Then, step 303 selects a freeze point based on the binary codes assigned to x, y, and z. As in the preferred embodiment, with variable x equal to 1, representing a normal-freeze cycle, the second control probe 52 is initially selected as the freeze point. However, there are two more variables to check in the alternate embodiment. With variable y equal to 0, representing valve loading, step 302 moves the freeze point up one probe from the second control probe 52 to the third control probe 53. Finally, with variable z equal to 0, representing a low ambient condition, step 302 moves the freeze point down one probe from the third control probe 53 to the second control probe 52. It should be understood that the programs used by the control unit 65 in the preferred and the alternate embodiments are merely examples. While the alternate embodiment selects a freeze point based on the three variables described above, any multitude of variables may be added or substituted including humidity, energy use, time of day, cycle times, temperature of water source, temperature of flavored syrup source, and temperature of carbon dioxide source. In addition, the control unit 65 can be programmed to consider the variables in a multitude of manners or sequences. Therefore, variables may be given greater or lesser importance and considered independently or in combination.

Referring again to the alternate embodiment, after the second control probe 52 is selected as the freeze point, the program 300 proceeds in the same way as described in the preferred embodiment. Therefore, as in the preferred embodiment, the program 300 will turn the cooling unit 1 on and off to maintain a desirable bank 5 size and shape. However, in the alternate embodiment, the freeze point can change automatically as the ambient conditions or valve loading conditions change. Using the control assembly and method described above, the growth of the frozen cooling bank can be regulated to achieve optimal thermodynamic performance under various conditions.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

What is claimed is:

1. A method for regulating growth of a frozen cooling bank in a beverage dispensing system, comprising:

monitoring sensor units positioned at different sides of the frozen cooling fluid bank to determine the size and shape of the frozen cooling bank;

starting a cooling unit if the sensor units indicate the frozen cooling bank does not cover a selected freeze point on all the sensor units; and stopping the cooling unit if the sensor units indicate the frozen cooling bank covers the selected freeze point on all the sensor units.

2. The method according to claim 1, further comprising stopping the cooling unit if the sensor units indicate the frozen cooling bank has problematic overgrowth at any one of the sensor units.

3. The method according to claim 1, further comprising determining the status of all variables considered when selecting a freeze point.

4. The method according to claim 3, further comprising selecting the freeze point based upon the conditions of the variables.

5. The method according to claim 3, wherein the variables considered are selected from the group consisting of freeze cycle, cycle times, ambient temperature, dispensing valve temperature, humidity, water source temperature, flavored syrup source temperature, energy use, time of day, and carbon dioxide source temperature.

6. The method according to claim 1, wherein the variable considered is a freeze cycle.

7. The method according to claim 6, wherein determining the variable status of "first-freeze" results in a selection of a freeze point to produce a smaller frozen cooling bank.

8. The method according to claim 6, wherein determining the variable status of "not a first-freeze" results in a selection of a freeze point to produce a larger frozen cooling bank.

9. The method according to claim 1, wherein the variable considered is ambient temperature.

10. The method according to claim 9, wherein determining the variable status of "low ambient temperature" results in a selection of a freeze point to produce a smaller frozen cooling bank.

11. The method according to claim 9, wherein determining the variable status of "high ambient temperature" results in a selection of a freeze point to produce a larger frozen cooling bank.

12. The method according to claim 1, wherein the variable considered is dispensing valve temperature.

13. The method according to claim 12, wherein determining the variable status of "dispensing valve temperature loading" results in a selection of a freeze point to produce a larger frozen cooling bank.

14. The method according to claim 1, further comprising running the cooling unit if overgrowth sensed by any one of the sensor units is not problematic.

* * * * *